US011311131B2

(12) United States Patent
Nguyen

(10) Patent No.: US 11,311,131 B2
(45) Date of Patent: Apr. 26, 2022

(54) GARMENT HOLDING DEVICE

(71) Applicant: Ryan Vinh Nguyen, Oakville (CA)

(72) Inventor: Ryan Vinh Nguyen, Oakville (CA)

( * ) Notice: Subject to any disclaimer, the term of this patent is extended or adjusted under 35 U.S.C. 154(b) by 0 days.

(21) Appl. No.: 17/114,636

(22) Filed: Dec. 8, 2020

(65) Prior Publication Data

US 2021/0169256 A1 Jun. 10, 2021

Related U.S. Application Data

(60) Provisional application No. 62/946,381, filed on Dec. 10, 2019.

(51) Int. Cl.
*A47G 25/40* (2006.01)
*A47G 25/44* (2006.01)

(52) U.S. Cl.
CPC ..... *A47G 25/40* (2013.01); *A47G 25/44* (2013.01)

(58) Field of Classification Search
CPC .... A47G 25/40; A47G 25/44; A47G 25/4046; A47G 25/4053; A47G 25/4076; A47G 29/10; A47G 29/08; A47G 29/083; A45C 13/30
See application file for complete search history.

(56) References Cited

U.S. PATENT DOCUMENTS 2,122,617 A * 7/1938 McD ..... A47G 25/14 223/92
2,588,235 A * 3/1952 Herrick ..... A47G 25/4076 223/90
3,611,760 A * 10/1971 Muther ..... E05B 37/025 70/18
4,579,431 A * 4/1986 Ansel ..... G03B 21/116 353/27 R
4,885,920 A * 12/1989 Larson ..... E05B 67/006 70/49
6,038,748 A * 3/2000 Durney ..... D06F 95/008 24/115 G
8,979,113 B1 * 3/2015 Rossi ..... A63C 9/002 280/637
2010/0072314 A1 * 3/2010 Sherman ..... D06F 53/045 242/388.91

* cited by examiner

*Primary Examiner* — Ismael Izaguirre

(57) ABSTRACT

The present invention is related to a garment holding device that can be attached to any kind of luggage bag carried by an individual. The device comprises a case having a first portion and a second portion; a first and second fastening means used to attach the first and second portions of the case; a pin, a torsion spring and a carabiner clip that is attachable to a bag strap; a cover that is detachably attachable to the case; a strap that is retractably stored in the case and is movably connected to the cover; a central drum that is supported by first drum support apparatus and second drum support apparatus; a coiled spring that enables the retractive moment of the strap; a lock; a first pin and a second pin, wherein the first pin is located in between a torsion spring, the lock and the second drum support apparatus; a torsion spring attached to the lock; and an adjustment buckle that is used to adjust the length of strap.

8 Claims, 23 Drawing Sheets

FIG. 20
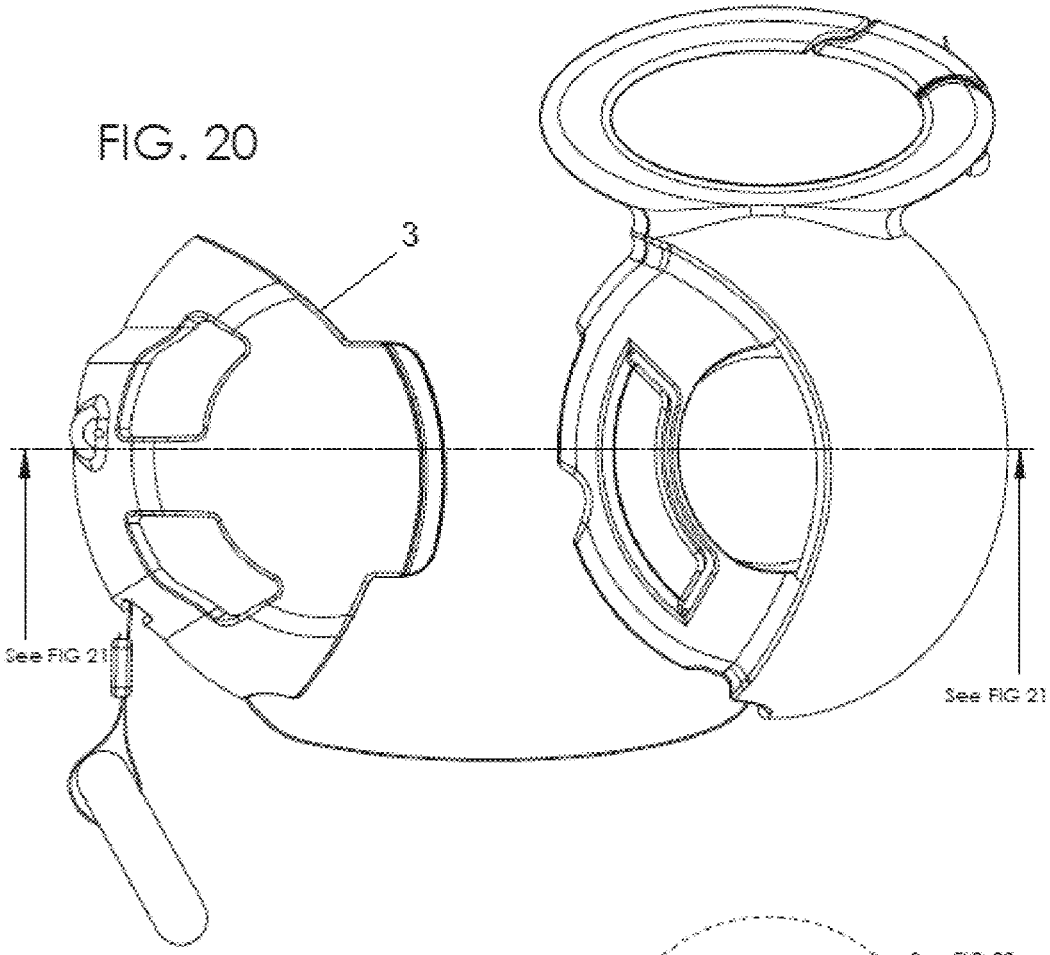
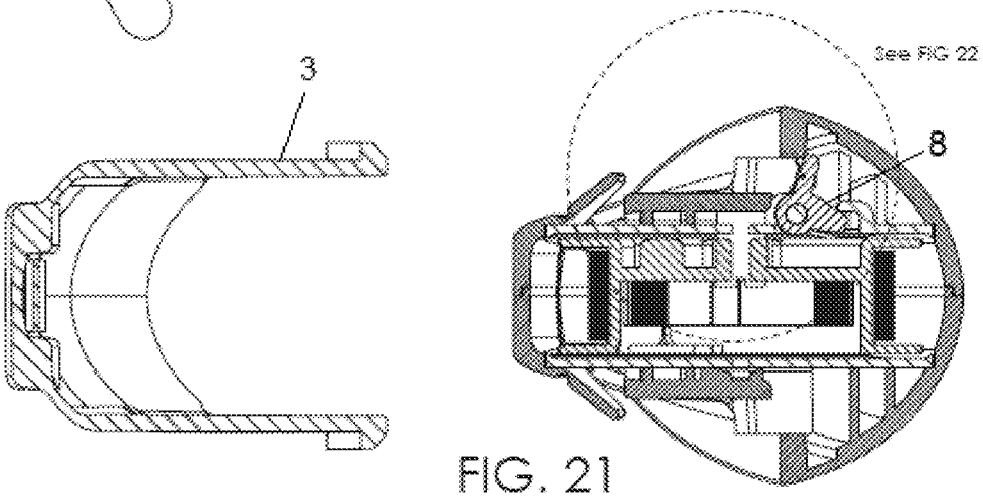
FIG. 21

GARMENT HOLDING DEVICE

CROSS-REFERENCE TO RELATED APPLICATIONS

For purposes of the USPTO extra-statutory requirements, the present application constitutes a non-provisional patent application of a U.S. provisional patent application Ser. No. 62/946,381, naming Ryan Vinh Nguyen as inventor, filed Dec. 10, 2019.

FIELD OF THE INVENTION

The subject matter described herein relates generally to the field of luggage. In particular, the subject matter described herein relates to a garment holding device that can be attached to any kind of bag carrying by an individual.

BACKGROUND OF THE INVENTION

It is problematic to carry garments such as over coats or jackets in hands while traveling or walking. Sometimes, the garments are too heavy to carry with hand for a long time and it will restrict the use of hands for other purposes. In particular, it is really difficult to have a coffee or answer a phone call while traveling or walking with a garment in hand. It is not always convenient to keep the garments in the bag or back pack every time when not in use. In some instances, people try to hang the garments through the lower part of shoulder straps of a back pack. However, the garments tend to slip and fall off from the shoulder straps of the back pack due to the movements caused by the body while walking.

These and many other problems have been long identified. Different solutions to the problems have been tried. However there exists no comprehensive solution to all the above problems. Therefore, the object of the invention overcomes above and other drawbacks from the prior art. To achieve above and other objects, the present invention provides a novel garment holding device that can be attached to various types of luggage and can be used to hold any type of garments such as over coats or jackets.

SUMMARY OF THE INVENTION

Embodiments of the invention solve the above-mentioned problems by providing a unique garment holding device that can be attached to various types of luggage and allows for more efficient retainment of garments such as over coats or jackets of any size and shape. The device works in a way that allows users to attach the attachment apparatus of the device to the luggage bag and the strap available in the device can be pulled to wrap around the garments such as over coats or jackets. Specifically, the device comprises a case having a first portion and a second portion; fastening means used to attach the first and second portions of the case; a pin, a torsion spring and a carabiner clip that is attachable to a bag strap; a cover that is detachably attachable to the case; a strap that is retractably stored in the case and is movably connected to the cover; a central drum that is supported by first drum support apparatus and second drum support apparatus; a coiled spring that enables the retractive moment of the strap; a lock; a first pin and a second pin, wherein the first pin is located in between a torsion spring, the lock and the second drum support apparatus; a torsion spring attached to the lock; and an adjustment buckle that is used to adjust the length of strap.

In particular, the strap available in the device has an ability to further tighten the loop around the jacket while not damaging the garment material, resulting in a secure yet non damaging grip.

This summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following detailed description, figures, and claims.

BRIEF DESCRIPTION OF THE DRAWINGS

Following drawings with reference numbers and exemplary embodiments are referenced for explanation purpose.

FIG. 20 is a side view of garment holding device further visualizing the detached front cover.

FIG. 21 is a horizontal sectional view of garment holding device and the detached front cover.

DETAILED DESCRIPTION OF THE INVENTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, embodiments of the invention can include a variety of combinations and/or integrations of the embodiments described herein.

The words "connected", "attached", "joined", "mounted", "fastened", and the like should be interpreted to mean any manner of joining at least two objects including, but not limited to, the use of any fasteners such as screws, nuts and bolts, bolts, pin and clevis, one or more sections of hooks and corresponding one or more sections of loops, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

The present invention provided a garment holding device that can be attached to various types of luggage is described which allows for more efficient retainment of garments such as over coats or jackets of any size and shape. The fundamental part of this invention is the use of strap pulled from the device to retain the garments and further attaching the strap to the device and tighten the strap for a better grip.

Figure 1:
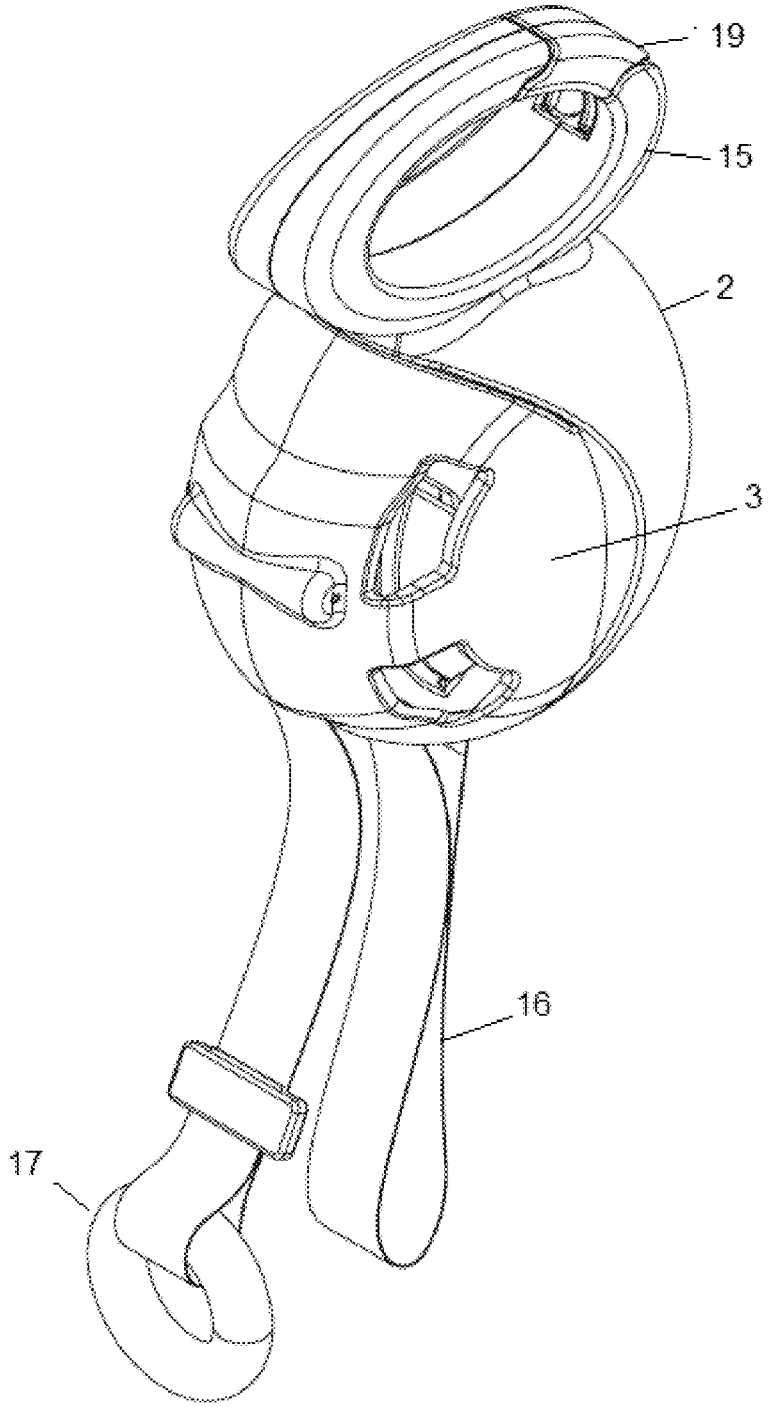
FIG. 1 is a perspective view of garment holding device.
Figure 2:
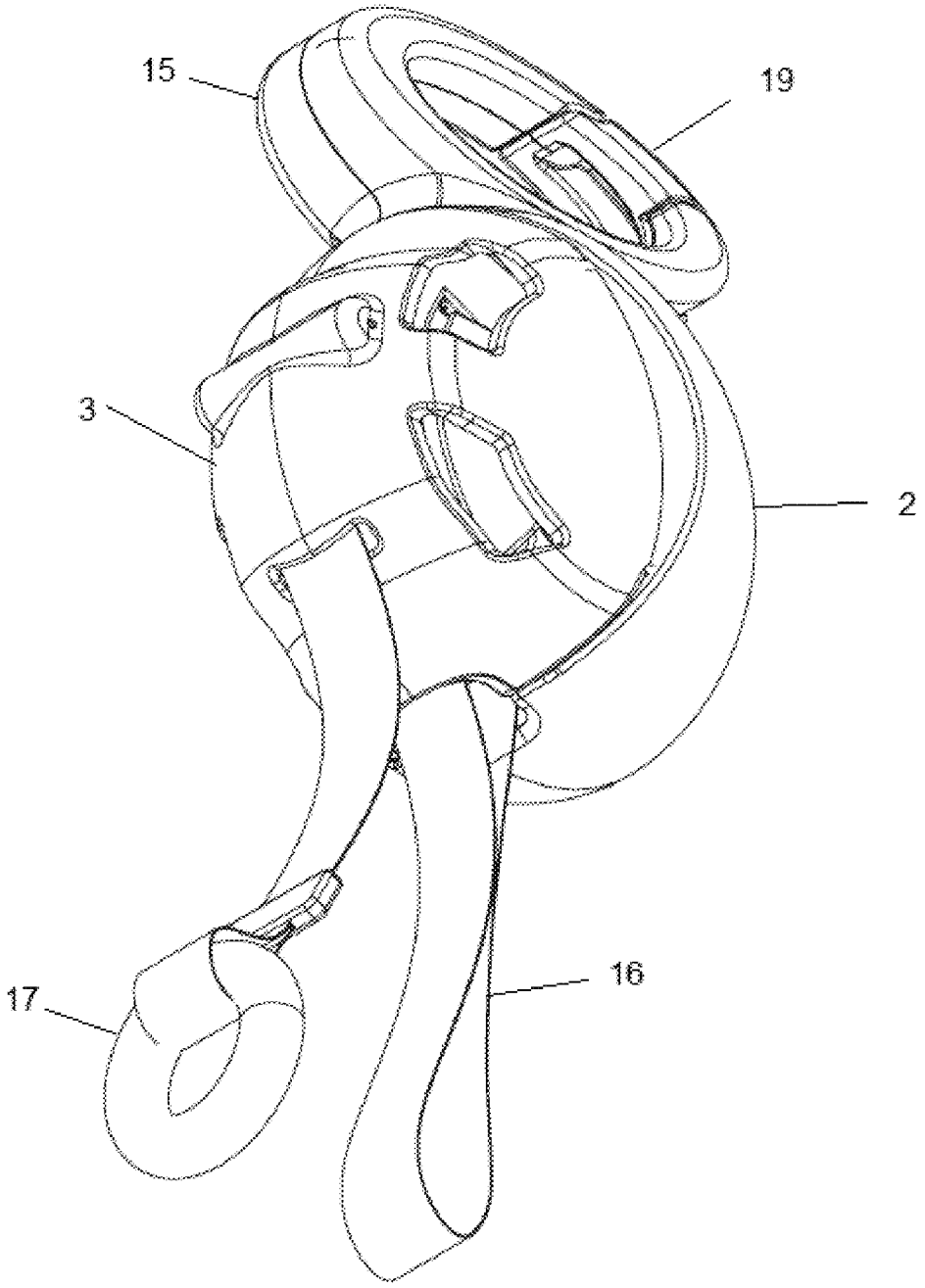
FIG. 2 is a lower perspective view of garment holding device.
Figure 3:
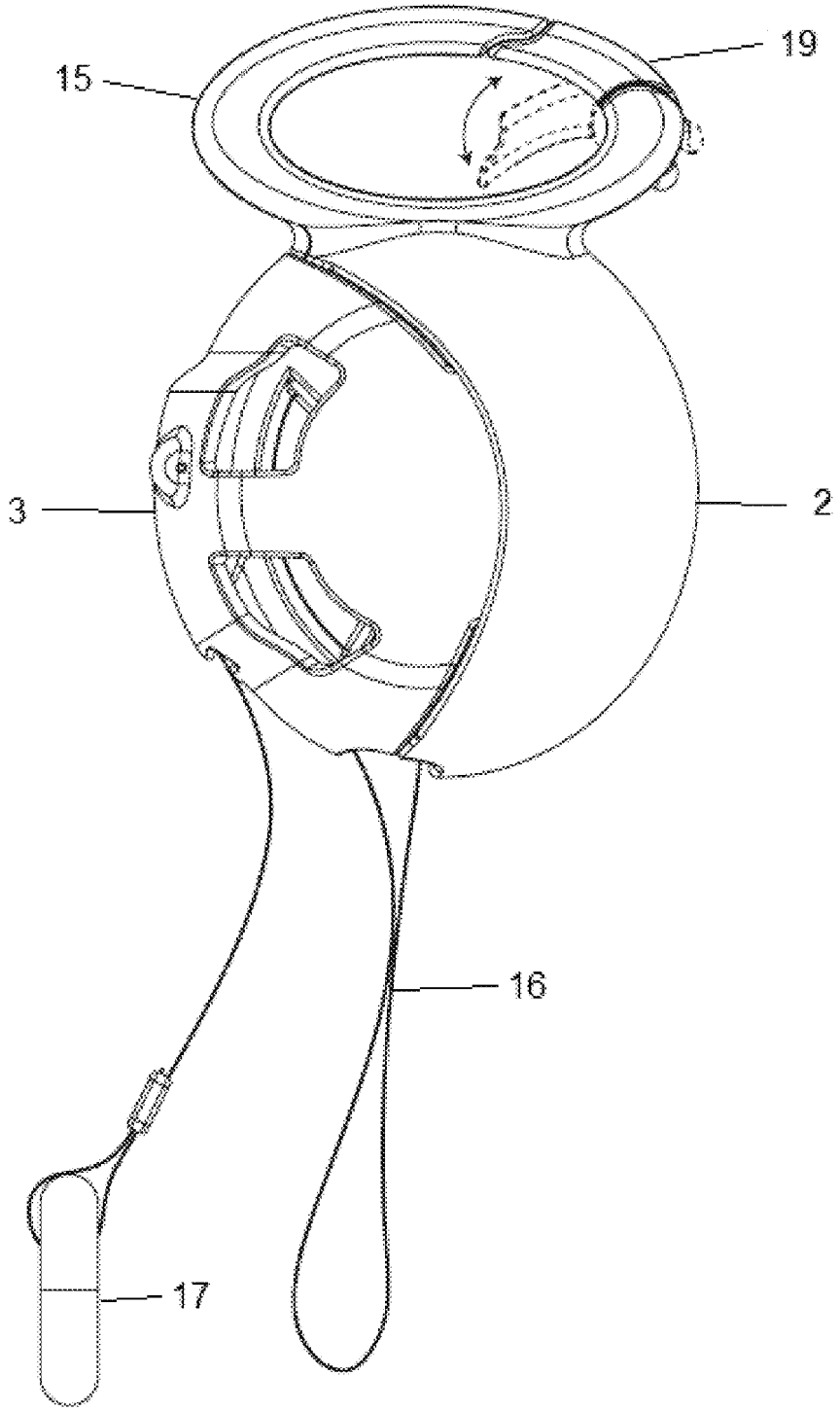
FIG. 3 is a side view of garment holding device.
Figure 4:
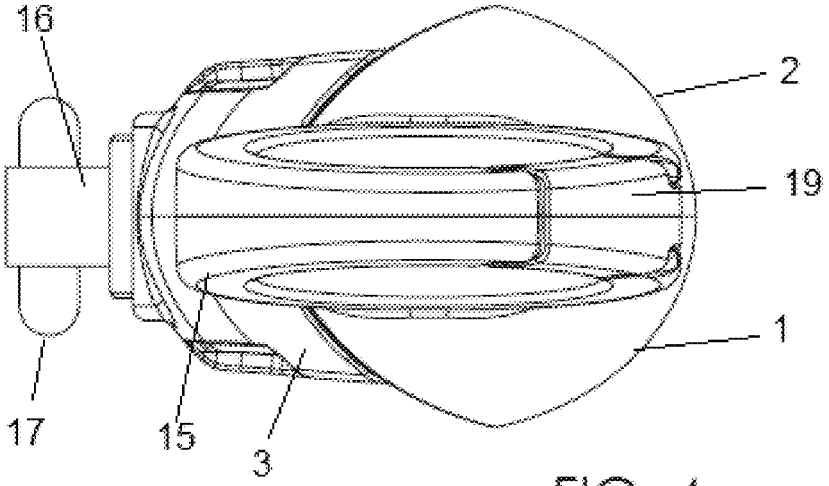
FIG. 4 is a top view of garment holding device.
Figure 5:
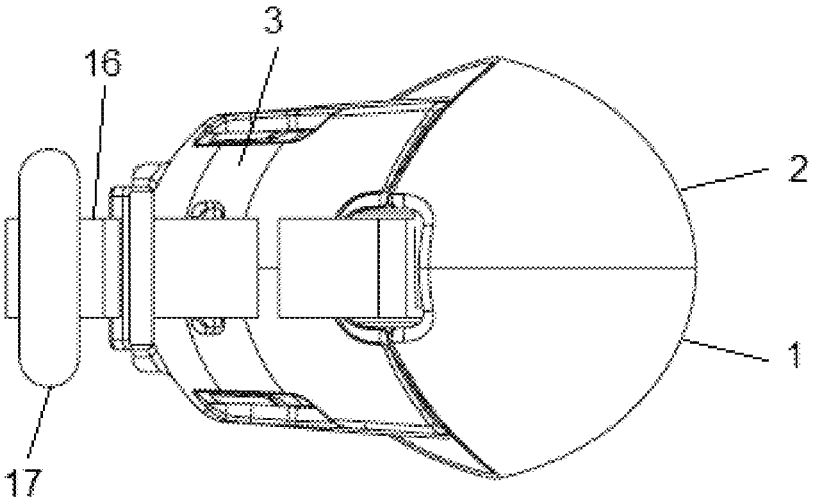
FIG. 5 is a bottom view of garment holding device.
Figure 6:
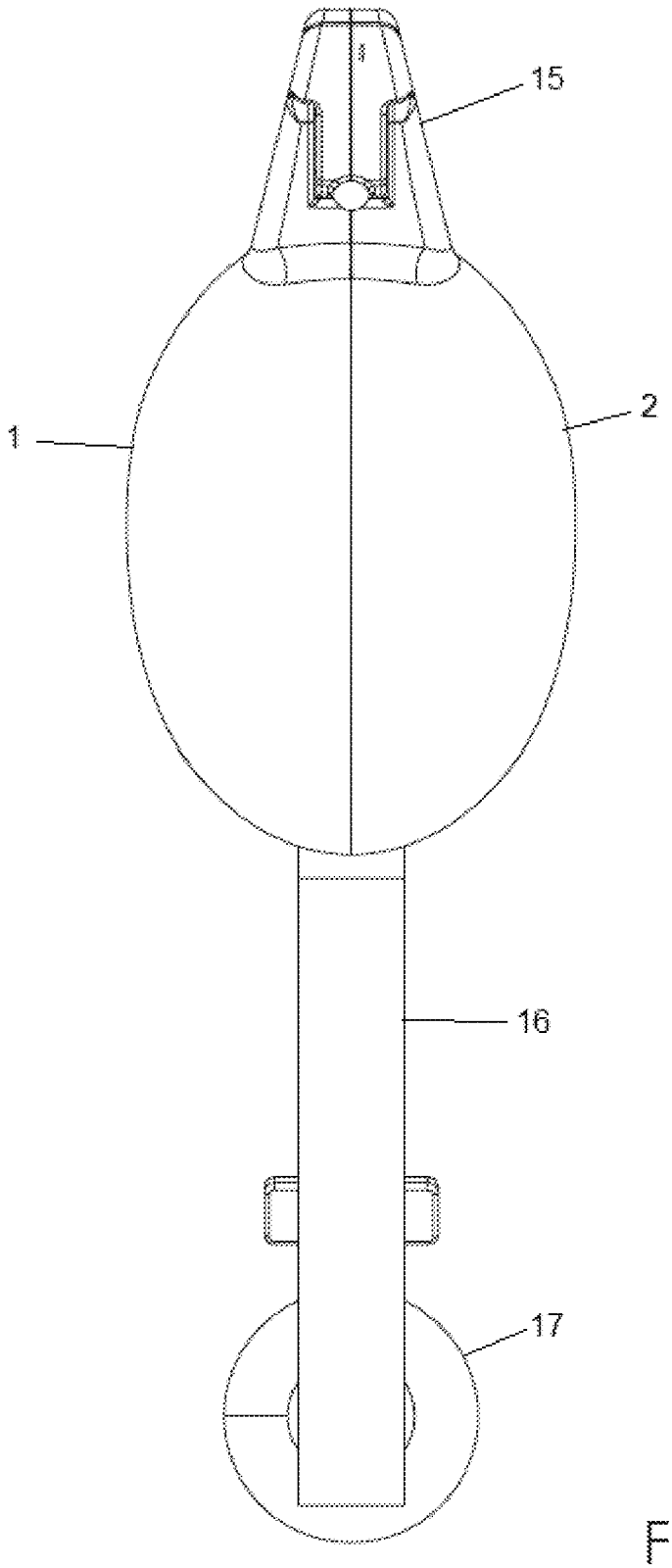
FIG. 6 is a back view of garment holding device.
Figure 7:
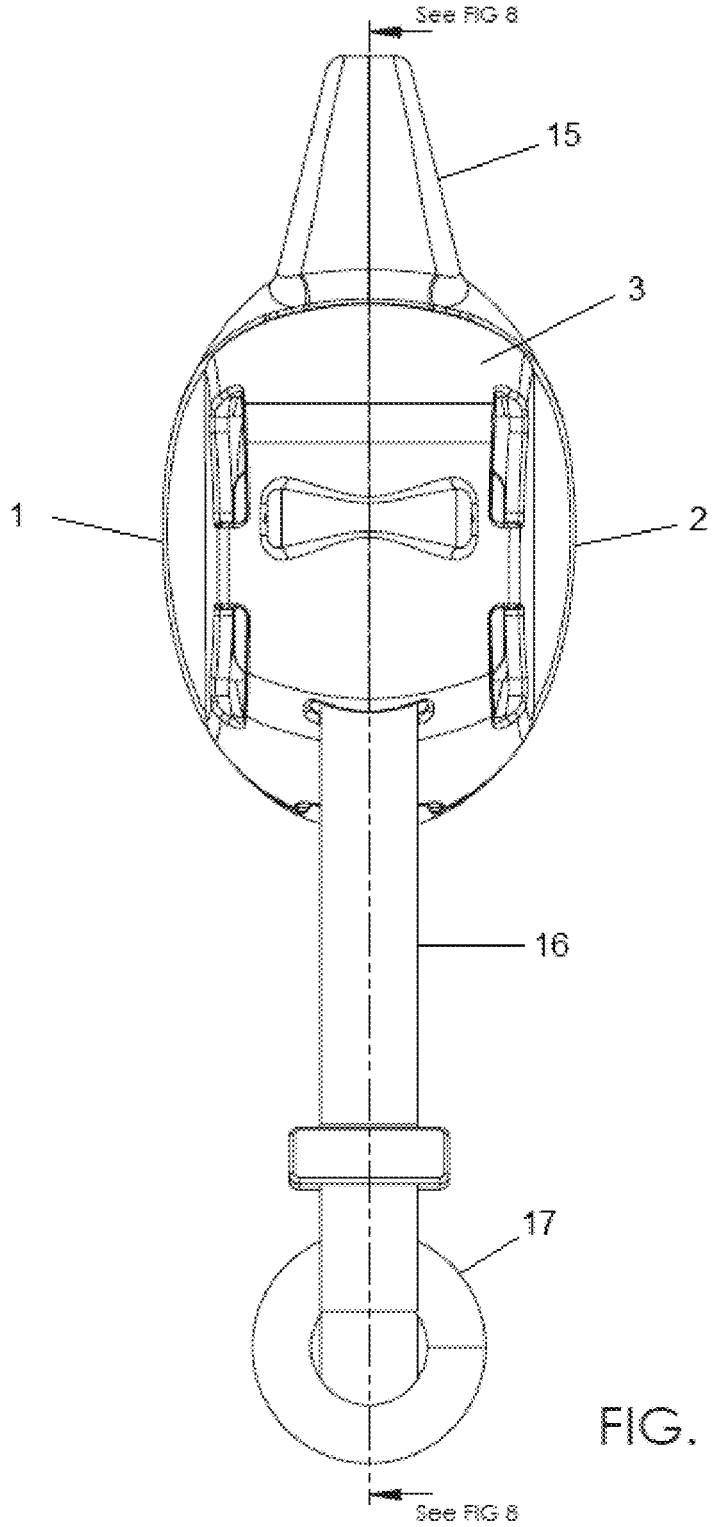
FIG. 7 is a front view of garment holding device.

Referring to the drawings in detail, FIG. 1 shows the perspective view of the device that visualizes the attachment apparatus 15 useful for attaching the device to any kind of luggage and the strap 16 that further includes a strap holding means 17. Correspondingly, FIG. 2 to FIG. 7 shows different views of the device that visualizes the attachment apparatus 15 useful for attaching the device to any kind of luggage and the strap 16 that can be pulled with the help of the strap holding means 17 that enables user to pull for further tightening the grip once the cover 3 has been reattached to the case.

Figure 8:
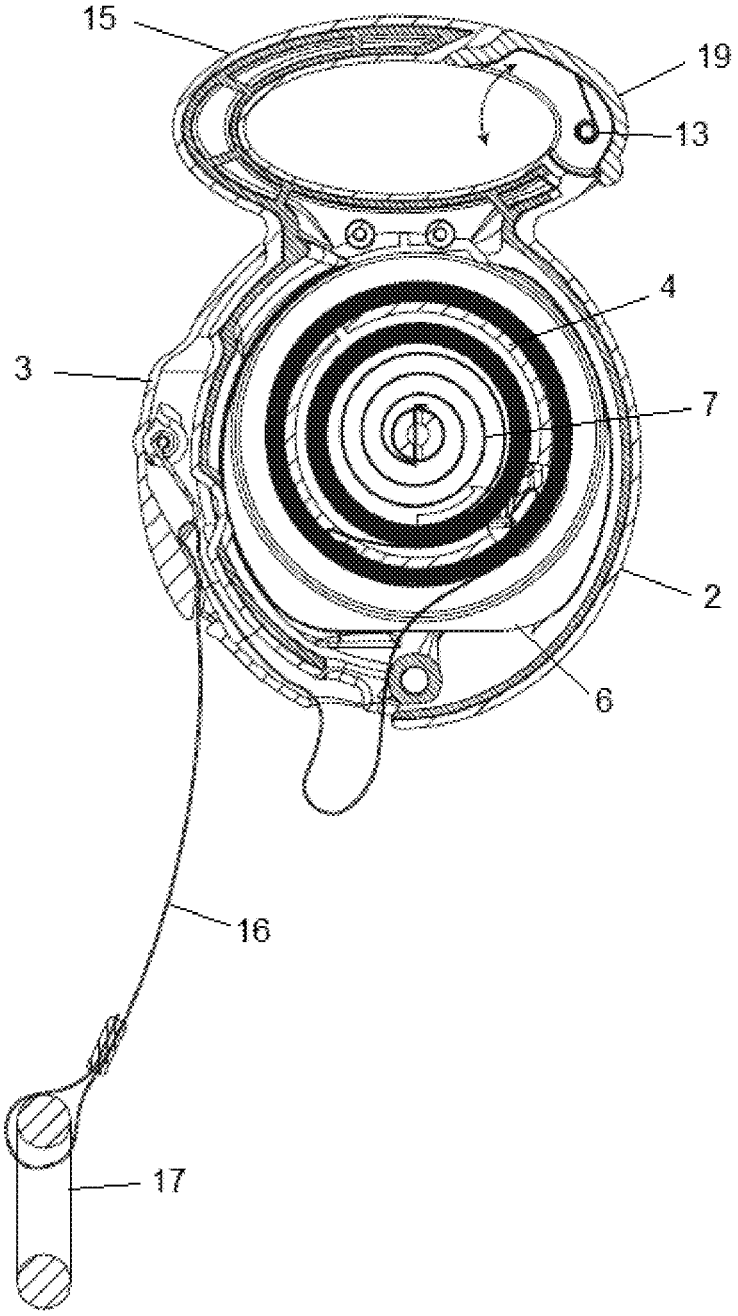
FIG. 8 is a vertical sectional view of garment holding device.
Figure 9:
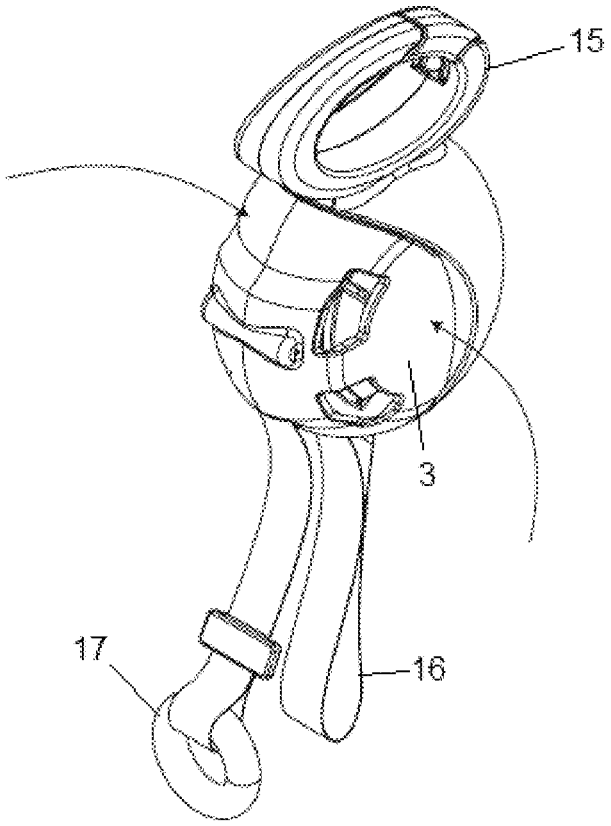
FIG. 9 is a perspective view of the garment holding device further visualizing the process of detaching the cover from the device.
Figure 10:
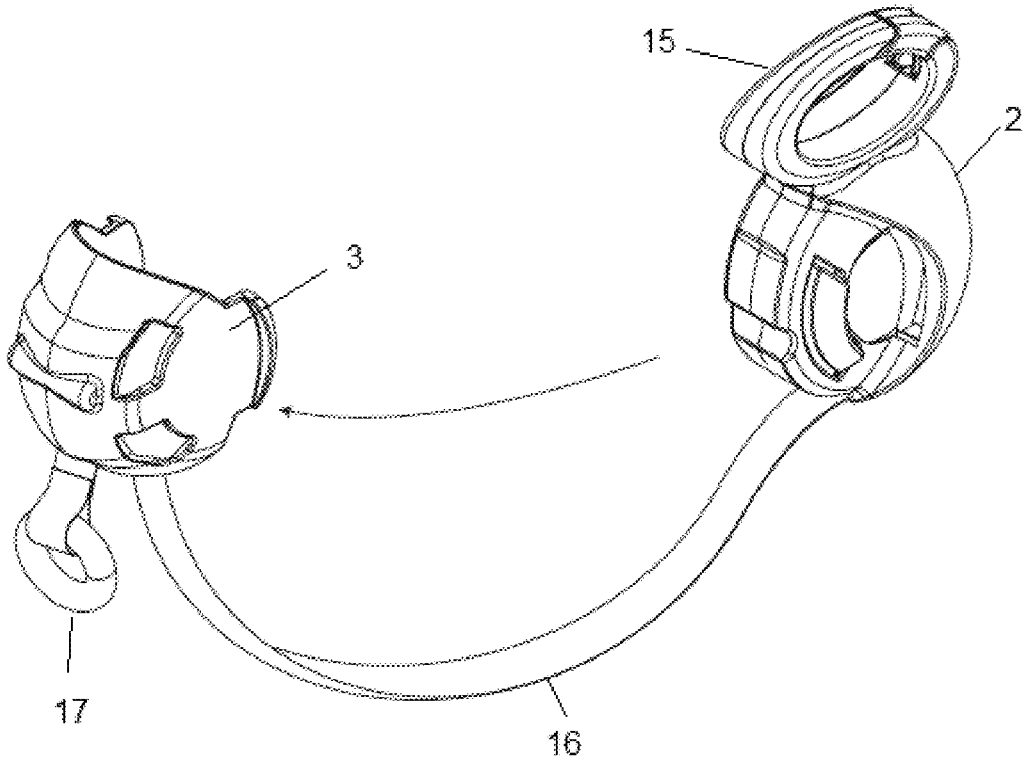
FIG. 10 is a perspective view of the garment holding device further visualizing the process of extending the strap for the device.
Figure 11:
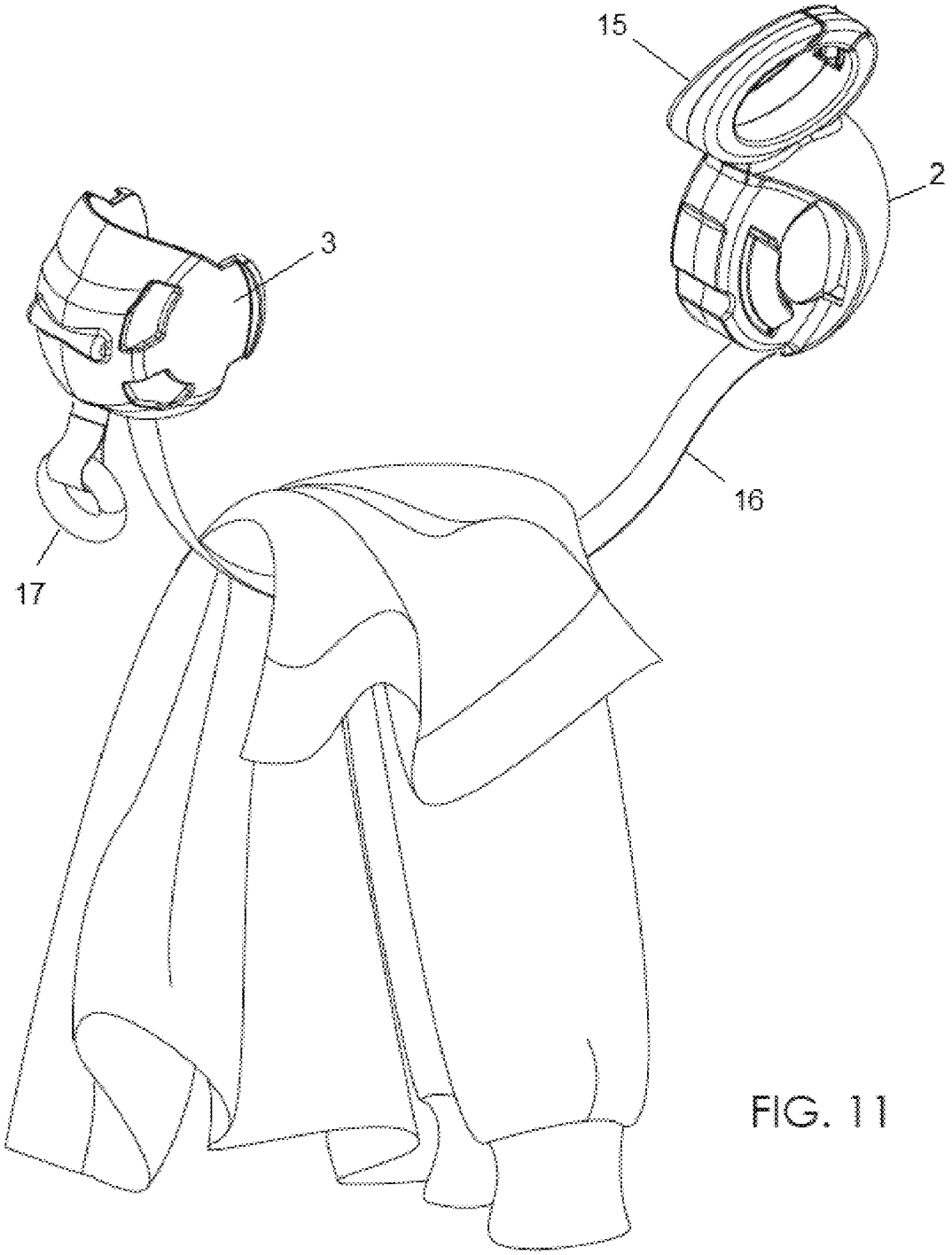
FIG. 11 is a perspective view of the garment holding device further visualizing the process of hanging the garment on the strap of the device.
Figure 12:
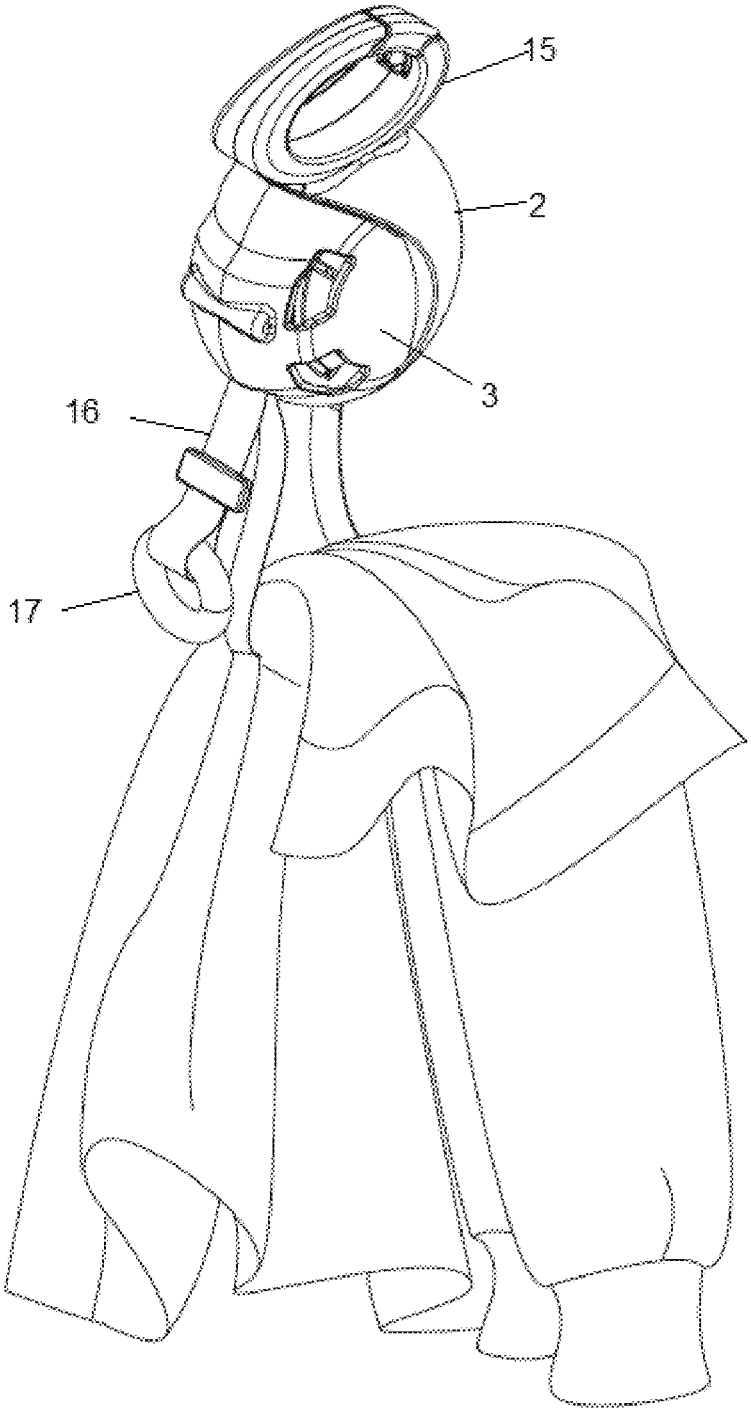
FIG. 12 is a perspective view of the garment holding device further visualizing the reattached cover to the device.
Figure 13:
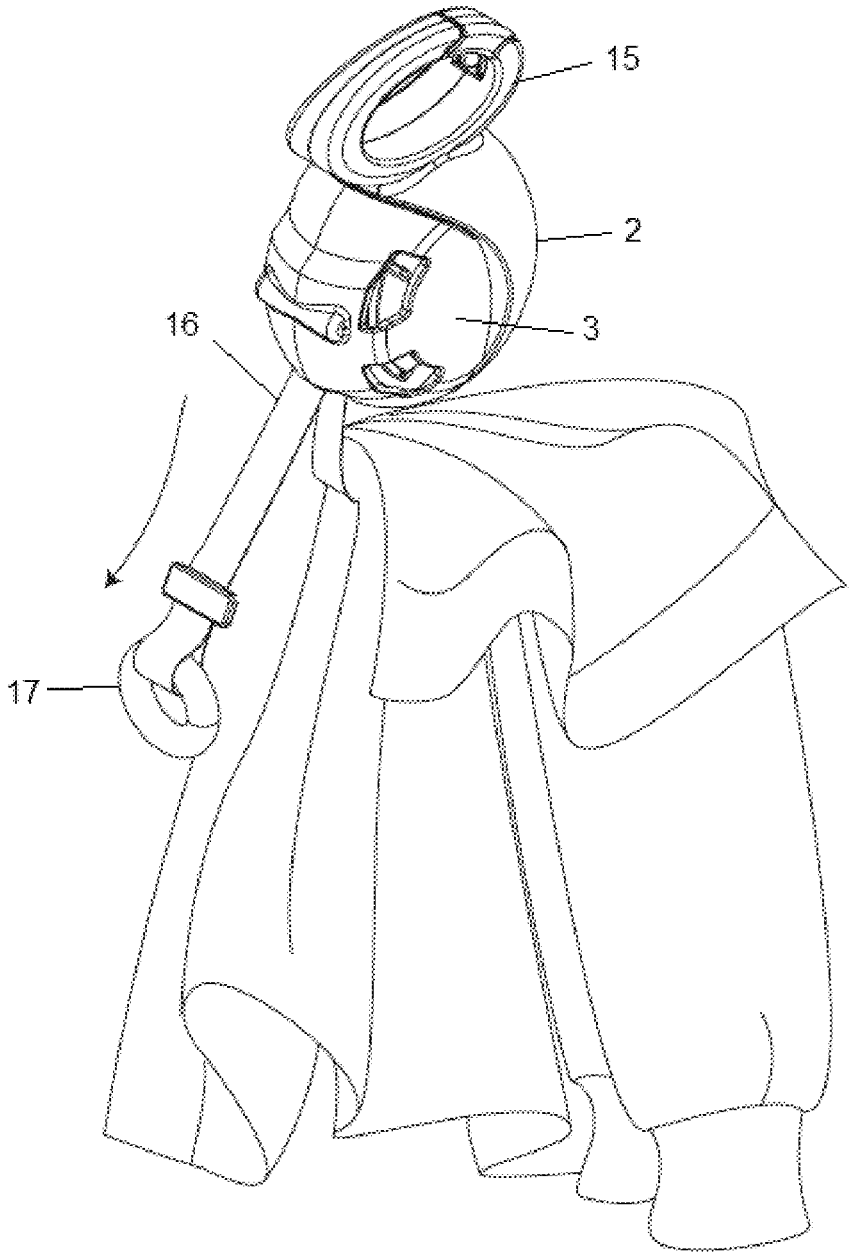
FIG. 13 is a perspective view of the garment holding device further visualizing process of tightening the strap of the device.
Figure 14:
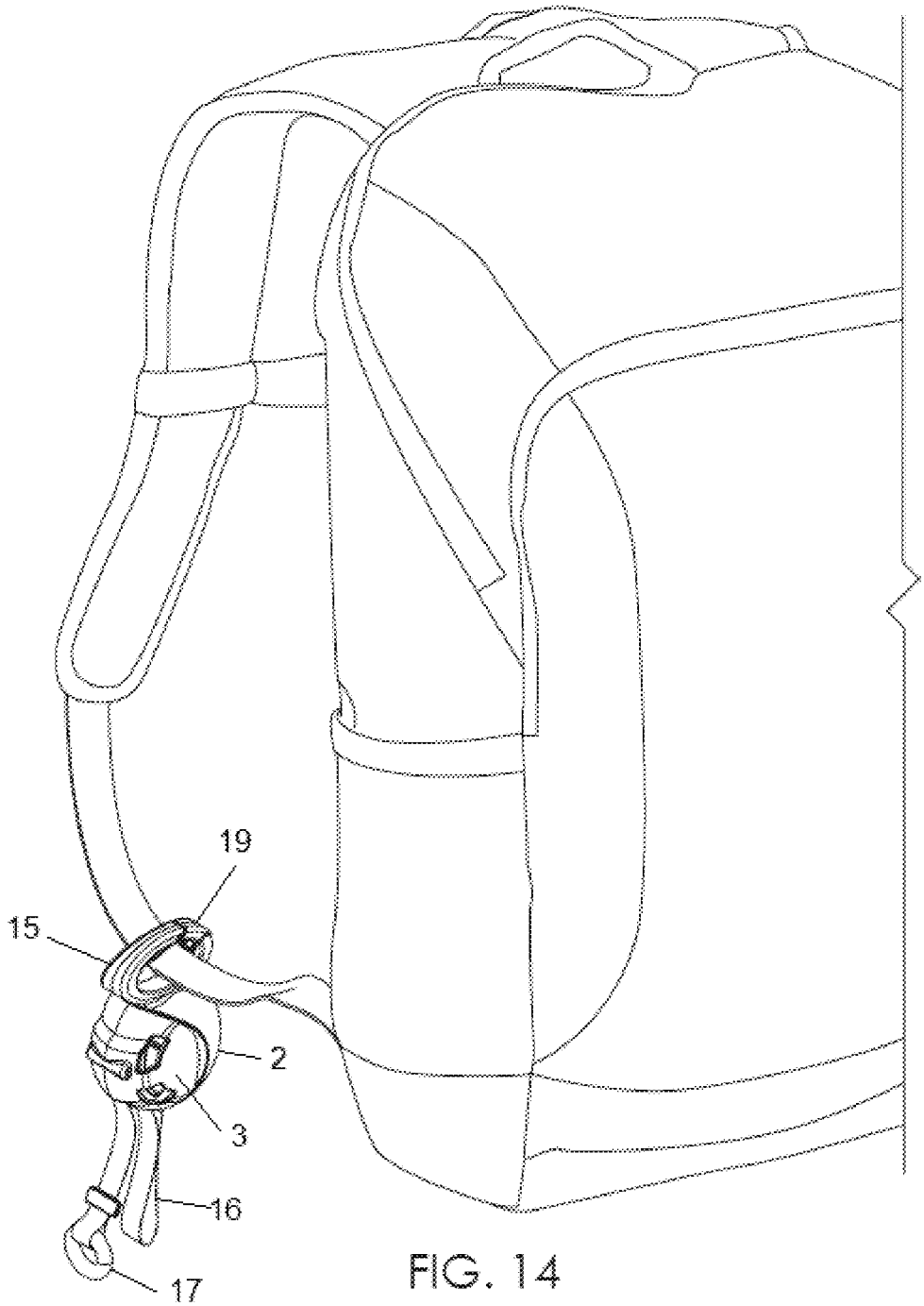
FIG. 14 visualizes the garment holding device attached to the strap of a backpack.
Figure 15:
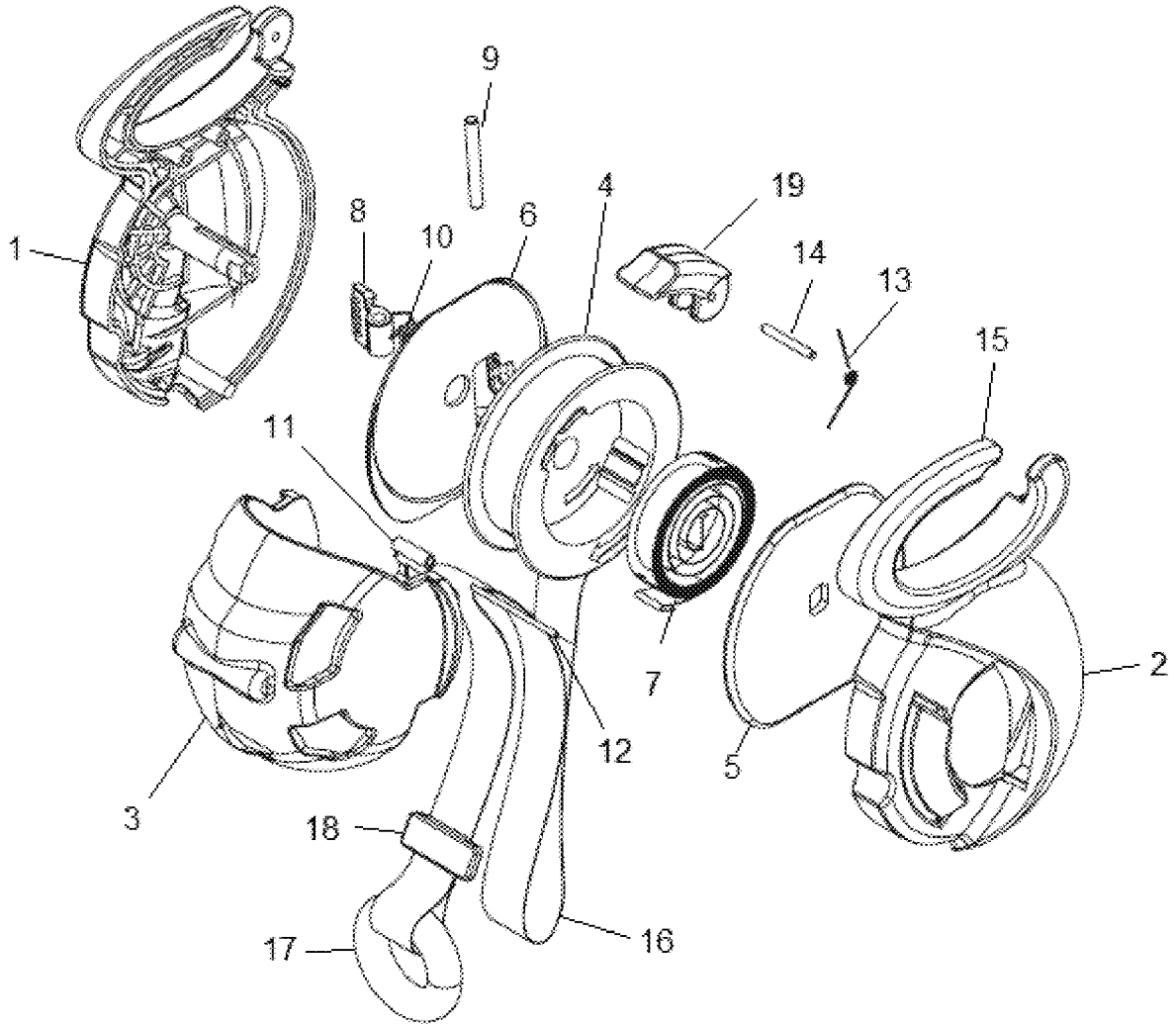
FIG. 15 is an exploded view of garment holding device.
Figure 16:
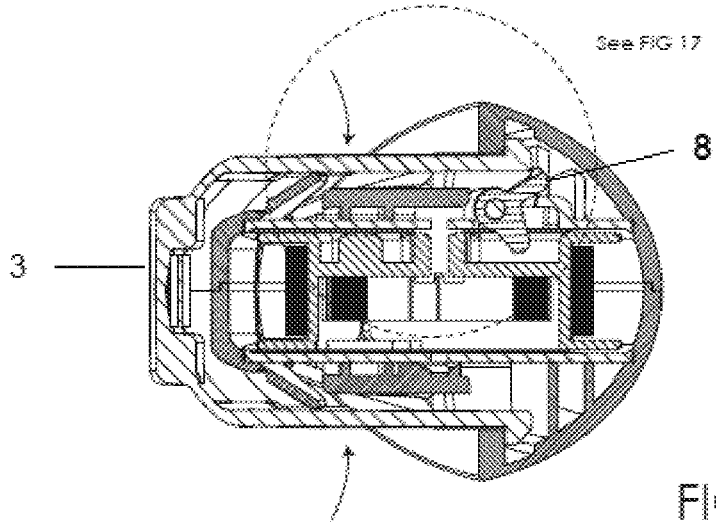
FIG. 16 is a horizontal sectional view of the locking mechanism of the garment holding device.
Figure 17:
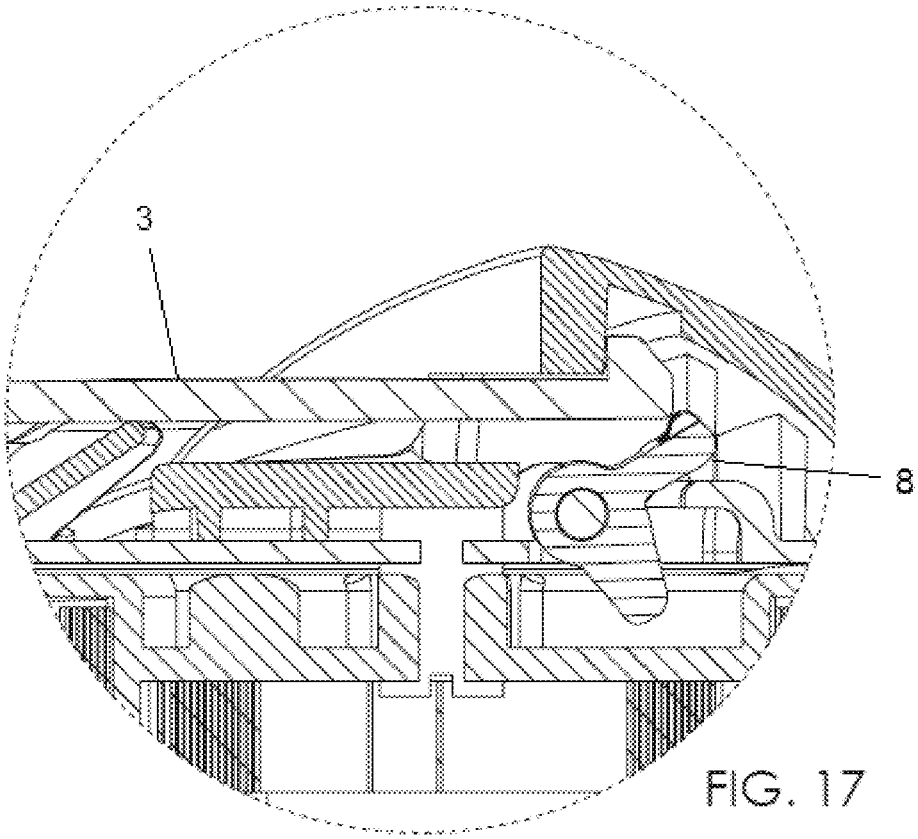
FIG. 17 is a focused view of the horizontal sectional view of the lock in a locked position preventing the strap from being extended.
Figure 18:
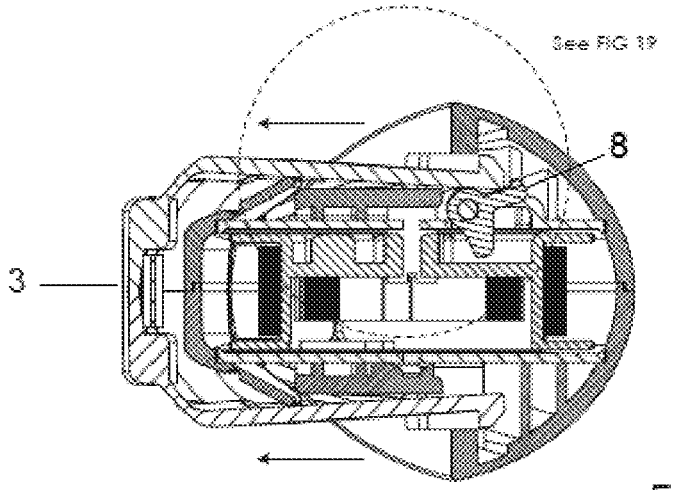
FIG. 18 is a horizontal sectional view of garment holding device further visualizing the process of detaching the front cover from the device.
Figure 19:
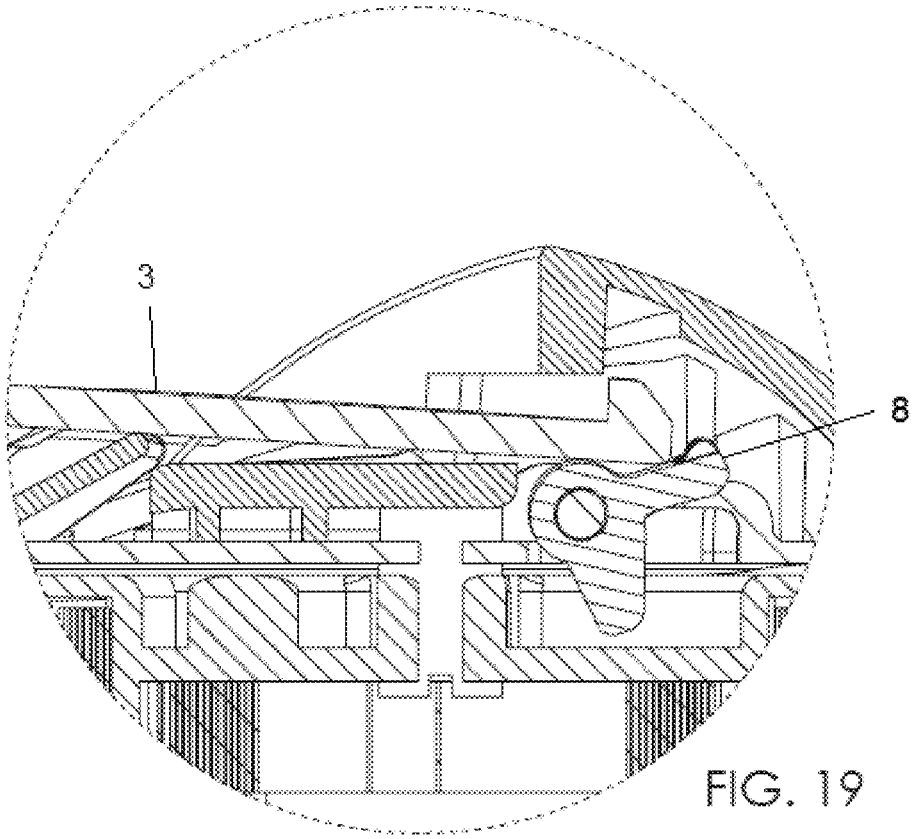
FIG. 19 is a focused view of the horizontal sectional view of garment holding device further visualizing the process of the lock being unlocked as the front cover is detached from the device.
Figure 22:
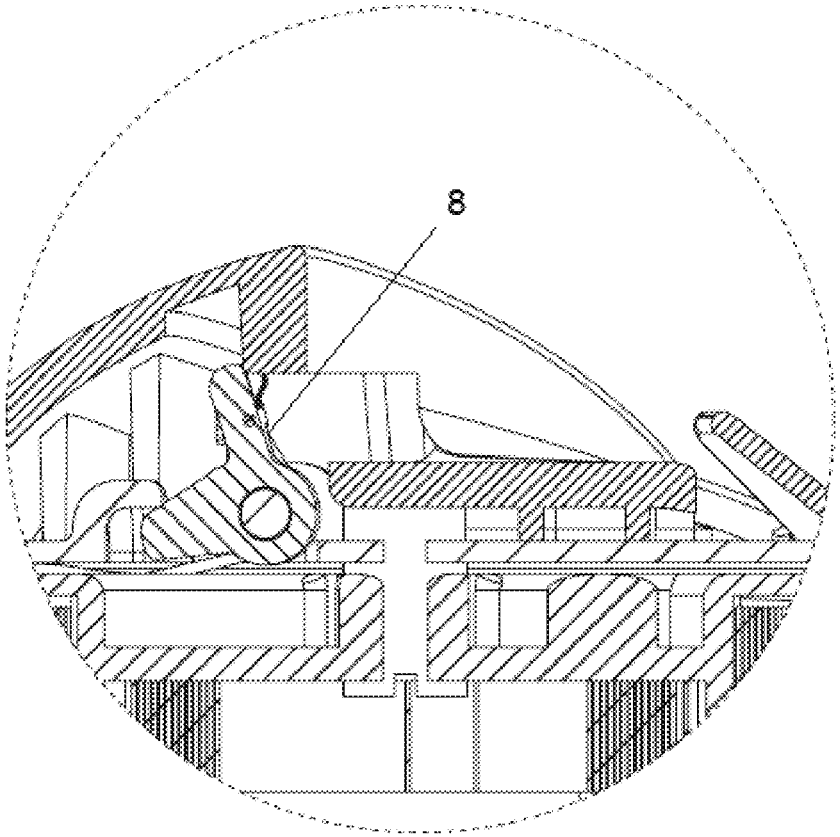
FIG. 22 is a focused view of the horizontal sectional view of the lock in an unlocked position allowing the strap to be extended or retracted.

FIG. 8 visualizes a vertical sectional view of garment holding device and FIG. 15 shows an exploded view of the garment holding device that further visualizes different parts of the garment holding device that enables the device to perform its functions in an efficient manner. In particular, the garment holding device as shown in FIG. 8 and FIG. 15 comprises of: a case having a first portion 1 and a second portion 2; a fastening means used to attach the first 1 and second 2 portions of the case; a pin 14, a torsion spring 13 and a carabiner clip 19 that is attachable to a bag strap; a cover 3 that is detachably attachable to the case; a strap 16 that is retractably stored in the case and is movably connected to the cover 3; a central drum 4 that is supported by first drum support apparatus 5 and second drum support apparatus 6; a coiled spring 7 that enables the retractive moment of the strap 16; a lock 8; a first pin 9 and a second pin 12, wherein the first pin 9 is located in between a torsion spring 10, the lock 8 and the second drum support apparatus 6; a torsion spring 10 attached to the lock 8; an adjustment buckle 11 that is used to adjust the length of strap 16; an attachment apparatus 15 to attach the device to a bag strap; a strap holding means 17 to adjust the tightness of the strap 16 around the garment; and a clip 18 to fasten the edge of the strap which is folded through the strap holding means 17.

Now referring to FIG. 9 to FIG. 14, the present invention includes a method of restraining the garments using the garment holding device, the method comprising steps of; (1) attaching the attachment apparatus 15 of the device to a bag strap; (2) applying force to the either sides of the cover 3 and detaching the cover 3 form the case and extending the strap 16 from the case; (3) hanging a garment on the strap 16; (4) reattaching the cover 3 to the case; (5) pulling the end of the strap 16 with the help of strap holding means 17 to adjust the tightness of the strap 16 around the garment; and (6) locking the strap 16 in desired position Turning to FIG. 16 to FIG. 22, the present invention provides the mechanism based on which the detachment and attachment of the cover 3 works; provides how the lock 8 secures cover 3 and strap 16.

Figure 23:
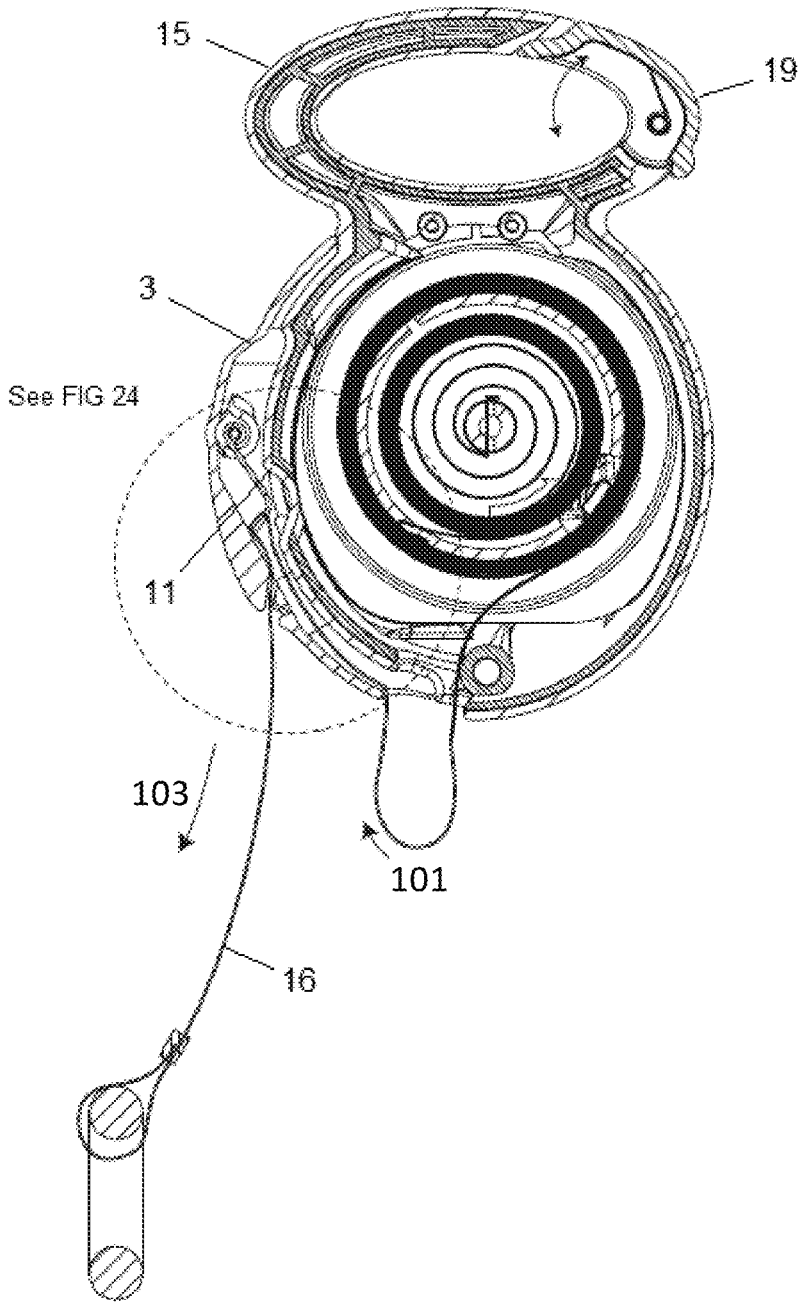
FIG. 23 is a vertical sectional view of garment holding device further visualizing the process of tightening the strap.
Figure 24:
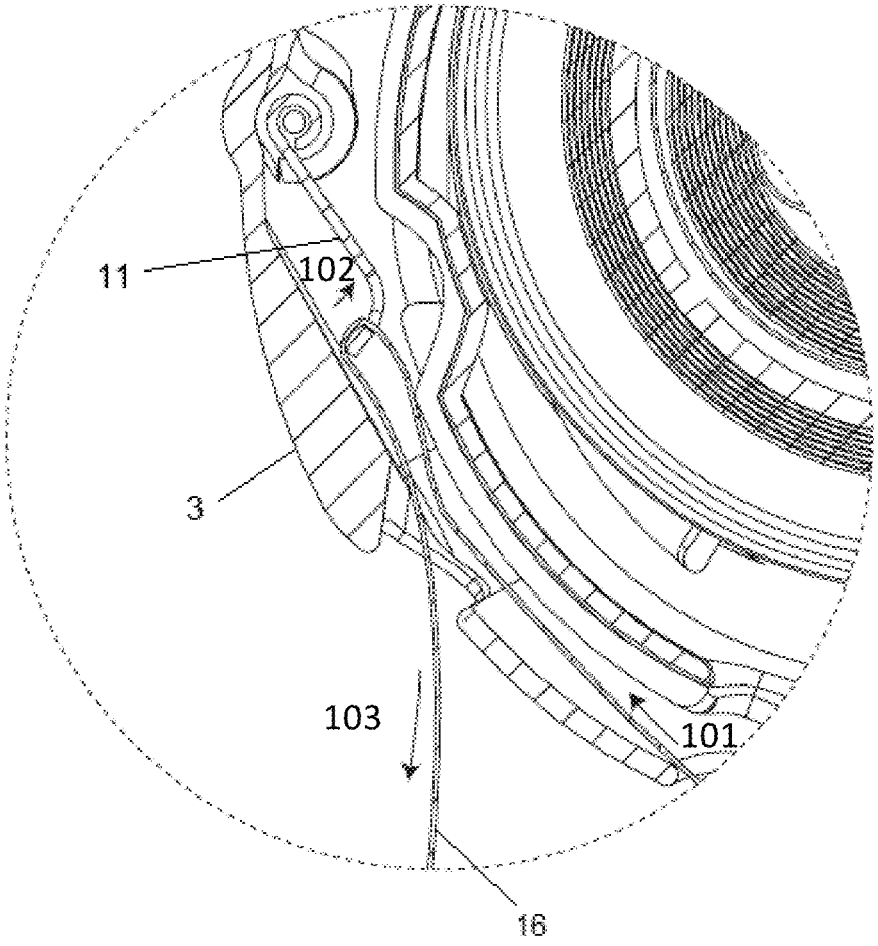
FIG. 24 is a focused view of the vertical sectional view of garment holding device further visualizing the process of tightening the strap.
Figure 25:
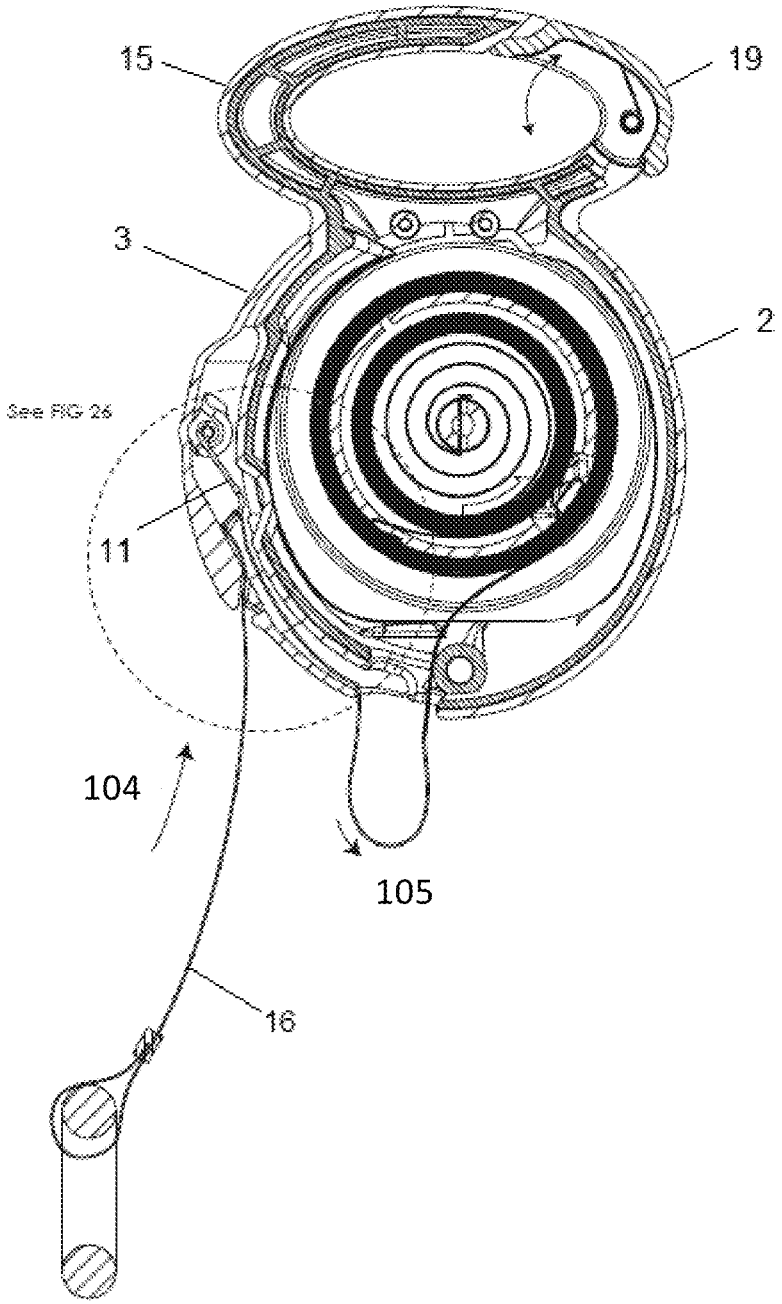
FIG. 25 is a vertical sectional view of garment holding device visualizing the process of retracting and locking the strap.
Figure 26:
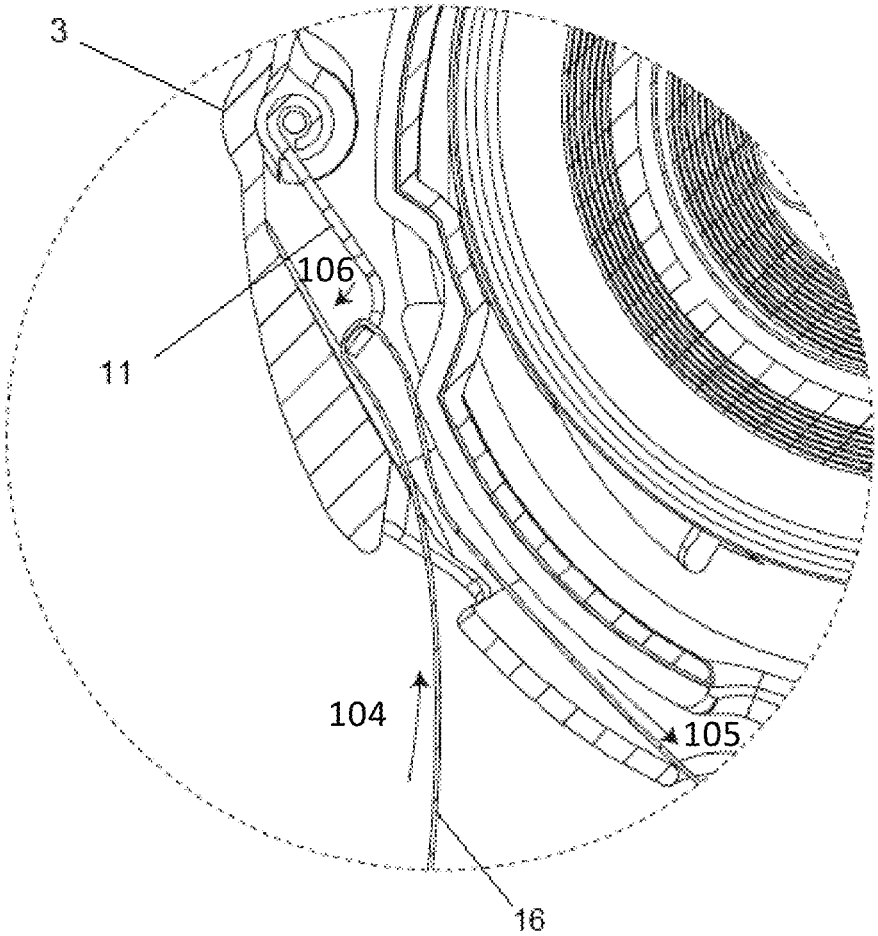
FIG. 26 is a focused view of the vertical sectional view of garment holding device further visualizing the process of retracting and locking the strap.

Now referring to FIG. 23 and FIG. 24, the present invention includes how the strap 16 can be adjusted and locked in a desired state by pulling the strap in forward direction that leads to the movement of the strap in route 101 under the cover 3; route 102 through adjustment buckle 11; route 103 through an opening of cover 3 and held firmly in place by adjustment buckle 11. Similarly, as shown in FIG. 25 and FIG. 26 the strap 16 can be adjusted and locked in a desired state by pulling the strap in backward direction 105 that leads to the movement of the strap in route 105 under the cover 3; route 106 through adjustment buckle 11; route 104 through an opening of cover 3 and held firmly in place by adjustment buckle 11.

Figure 27:
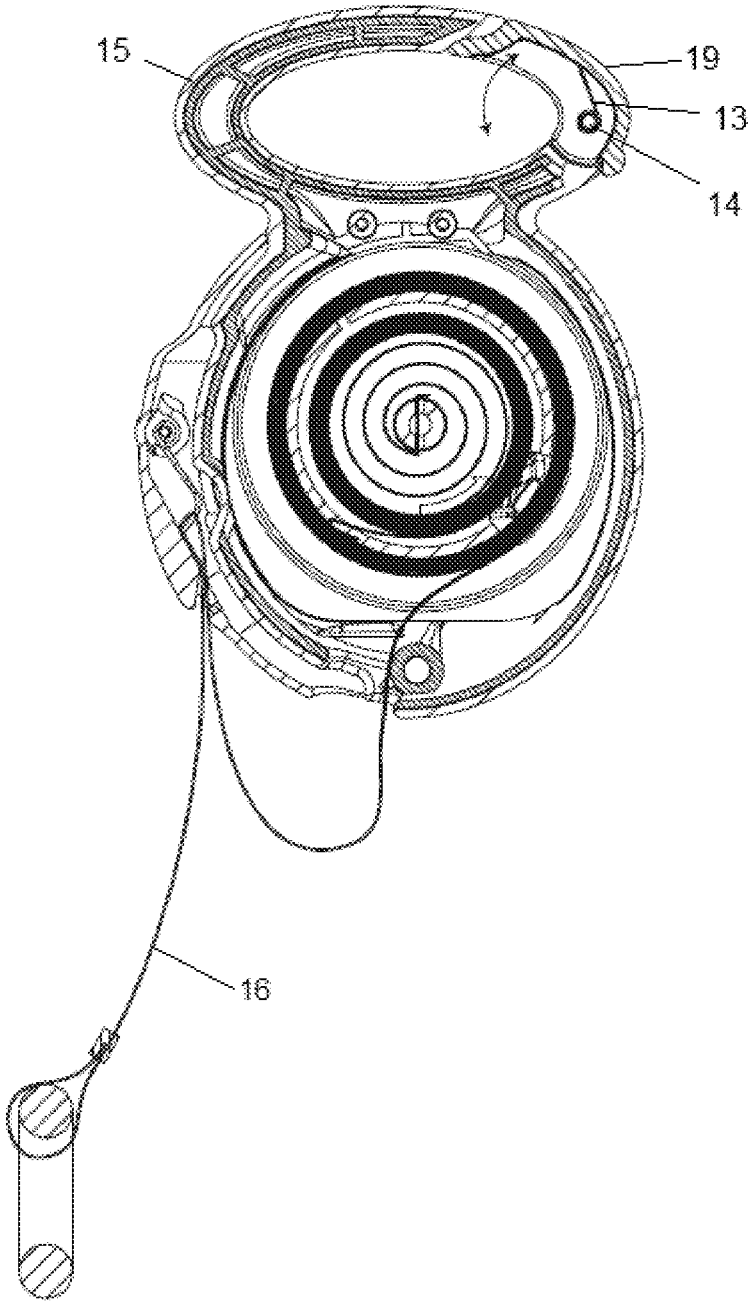
FIG. 27 is a vertical sectional view of garment holding device visualizing the movement of the carabiner clip.

Turning to FIG. 27, the present invention includes how the attachment apparatus 15, torsion spring 14, pin 13 and carabiner clip 19 enables the device to be attached to any kind of bag strap.

In one embodiment of the present invention, the extendable strap 16 of the device has an ability to further tighten the loop around the garment while not damaging the garment material, resulting in a secure yet non damaging grip.

In another embodiment of the present invention, the attachment apparatus 15 is considered universal as the feature enables the device to be attached to any kind of luggage with a strap size that can be fitted through the attachment apparatus.

In a further embodiment of the present invention, the lock 8 used to lock the strap 16 in a desired position.

Although embodiments of the invention have been described with reference to the embodiments illustrated in the attached drawing figures, it is noted that equivalents may be employed and substitutions made herein without departing from the scope of the invention as recited in the claims.

Having thus described in various embodiments of the invention, what is claimed as new and desired to be protected by Letters Patent includes the following:

1. A garment holding device, the garment holding device comprising:

a case having a first portion and a second portion;

an attachment apparatus that enables lockable detachable attachment of the device;

a fastening means to attach the first and second portions of the case;

a cover that is detachably attachable to the case;

a strap that is retractably stored in the case and is movably connected to the cover;

a central drum that is supported by first drum support apparatus and second drum support apparatus;

a coiled spring that enables the retractive moment of the strap;

a lock;

a first pin and a second pin, wherein the first pin is located in between the central drum and the second drum support apparatus;

a torsion spring attached to the lock;

an adjustment buckle that is used to adjust the length of strap;

a strap holding means; and a clip to fasten the edge of the strap which is folded through the strap holding means.

2. A garment holding device of claim 1, wherein the attachment apparatus is a clip.

3. A garment holding device of claim 1, wherein the attachment apparatus is lockable and enables the device to be detachably attached to luggage with a strap size that is fitted through the attachment apparatus.

4. A garment holding device of claim 2, wherein the clip is spring loaded.

5. A garment holding device of claim 1, wherein the end of strap includes a strap holding means that enables user to firmly hold the strap while extending the strap from the device.

6. A garment holding device of claim 1, wherein the strap tightens the loop around the garment while not damaging the garment material, resulting in a secure yet non damaging grip.

7. A garment holding device of claim 1, wherein the lock is for locking the strap in a desirable position.

8. A method of using the garment holding device, the method comprising the steps of:

attaching the attachment apparatus of the device to a bag strap;

applying force to the either sides of the cover and detaching the cover form the case and extending the strap from the case;

hanging a garment on the strap;

reattaching the cover to the case;

pulling the end of the strap to adjust the tightness of the strap around the garment; and locking the strap in desired position.

* * * * *